United States Patent [19]

Davis

[11] 4,083,345

[45] Apr. 11, 1978

[54] FUEL INJECTION PUMP

[75] Inventor: Charles W. Davis, Simsbury, Conn.

[73] Assignee: Stanadyne, Inc., Windsor, Conn.

[21] Appl. No.: 621,945

[22] Filed: Oct. 14, 1975

[51] Int. Cl.[2] ..... F02M 59/08

[52] U.S. Cl. ..... 123/139 ST; 123/179 L; 417/286

[58] Field of Search ..... 417/286, 295; 123/139 ST, 179 G, 179 L, 139 AN, 139 BA

[56] References Cited

U.S. PATENT DOCUMENTS

| | | | |
|---|---|---|---|
| 3,000,319 | 9/1961 | Tuck | 417/286 X |
| 3,105,441 | 10/1963 | Grill et al. | 417/286 X |
| 3,692,432 | 9/1972 | Liang et al. | 417/286 |

*Primary Examiner*—Charles J. Myhre
*Assistant Examiner*—Tony M. Argenbright
*Attorney, Agent, or Firm*—Prutzman, Hayes, Kalb & Chilton

[57] ABSTRACT

A rotary distributor fuel injection pump is provided with a main high pressure pumping chamber and an auxiliary high pressure pumping chamber which have a common inlet and outlet passage. The pumping plungers in said pumping chambers operate in unison to generate simultaneous high pressure pulsed charges of fuel within the pumping chambers. Both pumping chambers are connected to deliver their high pressure outputs simultaneously to the output passage for delivery sequentially to each of the cylinders of an associated engine. A speed responsive valve controls the delivery of the output from the auxiliary pumping chamber to the common outlet passage and isolates the auxiliary chamber from the common inlet and outlet passage without impairing the connection of the main pumping chamber with the common inlet and outlet passage when engine speed reaches a predetermined level. A valving arrangement is provided to maintain the auxiliary pumping chamber in its isolated condition until the engine is essentially stopped.

16 Claims, 5 Drawing Figures

FUEL INJECTION PUMP

The present invention relates to fuel injection pumps employed for supplying discrete metered charges of liquid fuel to an associated internal combustion engine, and more particularly to a rotary distributor type pump for an engine of the compression-ignition type.

Fuel pumps of the type involved in this invention deliver metered charges of liquid fuel sequentially to the several cylinders of an associated engine in timed relationship to its operation. When such engines are being cranked for starting after a period of prolonged idleness, the low cranking speed coupled with the relatively cold temperature of the engine adversely effects the combustion process due to the lower pressures and temperature in the combustion chamber. As a result, a higher than normal amount of fuel delivery is beneficial until the engine is started and normal operating speed is reached. In addition, the fuel delivered by a fuel injection pump at cranking speed may be considerably less than at normal operating speed because of leakage, particularly when the engine is hot and fuel viscosity is low. Delivery may be so low that starting is difficult or impossible. This is a particular problem with small engines where the quantity of fuel injected is small. Moreover, the initiation of combustion is improved when small droplet size predominates in the atomized fuel injected into a cylinder. It is, therefore, an object of this invention to provide an improved fuel pump for internal combustion engines which improves the starting characteristics of the associated engine.

Another object of this invention is to provide an improved fuel pump for a compression-ignition engine which increases the amount of fuel injected into the cylinder at cranking speeds and automatically continues the increased fuel injection through the first acceleration to a predetermined speed level. Included in this object is the provision of means to discontinue the delivery of the increased amount of fuel automatically at the predetermined speed level and thereafter to lock out the functioning of the pump to provide such increased amount of fuel until the engine is substantially stopped.

Still another object of this invention is to provide a fuel injection pump which increases the rate of injection of fuel by the pump under cranking conditions thereby to cause higher injection pressure and smaller droplet size to predominate in the atomized spray of the fuel injected into the engine.

Other objects will be in part obvious and in part pointed out more in detail hereinafter.

A better understanding of the invention will be obtained from the following detailed description and the accompanying drawings of an illustrative application of the invention.

Figure 1:
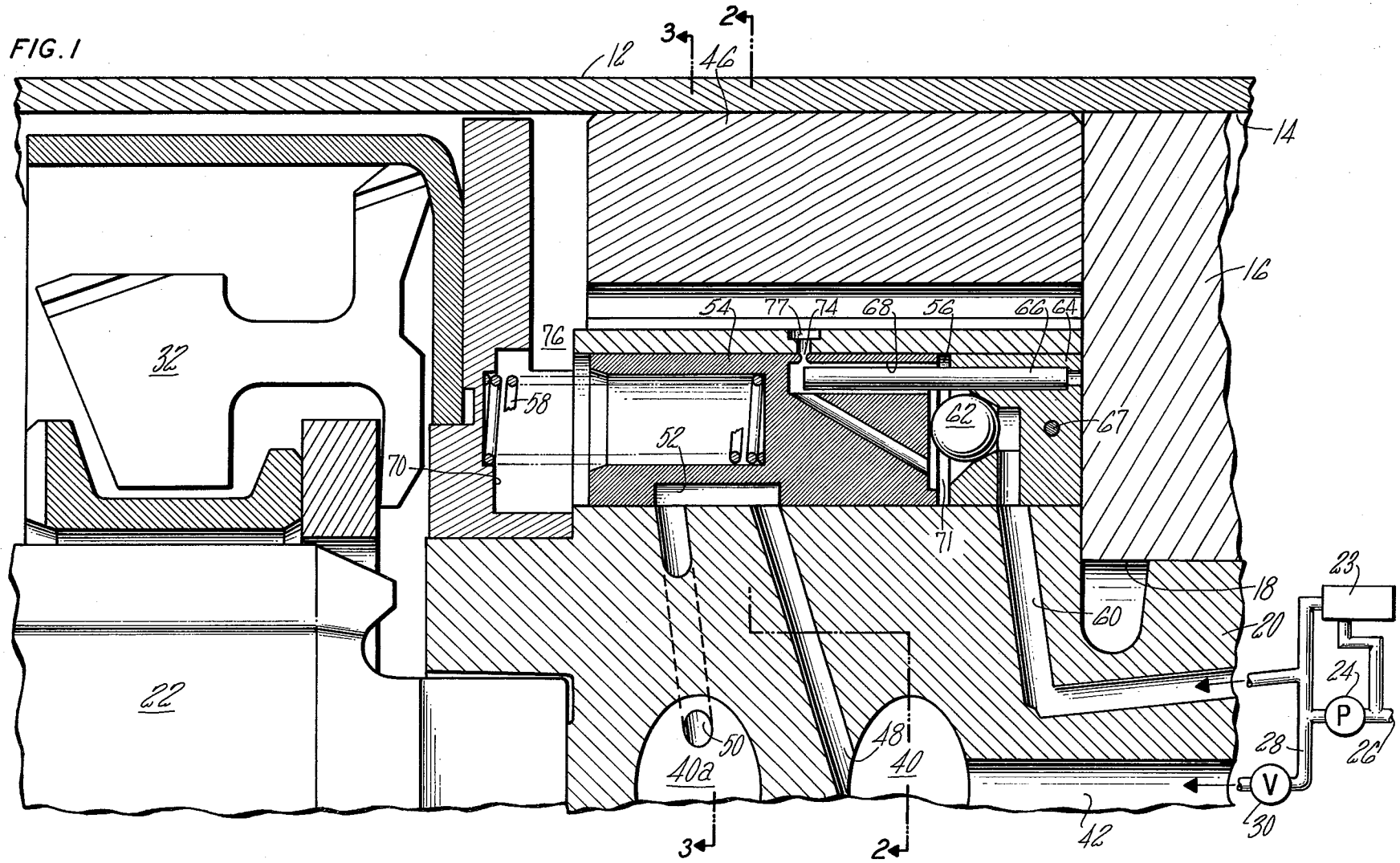
FIG. 1 is a fragmentary longitudinal cross-sectional view, partly broken away and partly schematic, of a fuel pump incorporating a preferred embodiment of the present invention.

Referring now to the drawings in detail, a fuel pump exemplifying the present invention is shown to be of the type adapted to supply metered charges or pulses of fuel sequentially to the fuel injection nozzles of the several cylinders of an internal combustion engine. A pump housing 12 encloses the pump and provides a bore 14 in which a hydraulic head 16 is secured to provide a cylindrical bore 18 in which a rotary distributor 20 is journaled for rotation. A stub shaft 22 operatively connects the rotor 20 to the associated engine for rotating the same.

A low pressure positive displacement transfer pump 24 receives fuel from a reservoir (not shown) by means of a pump inlet 26 which in conjunction with pressure regulator 23 provides an output pressure generally correlated with engine speed. The output of pump 24 is delivered through a conduit 28 to a variable metering valve 30 which regulates the delivery of fuel by the pump in a known manner such as by centrifugal governor having flyweights 32 which controls the metering valve setting in accordance with speed. The specific governor arrangement forms no part of this invention and one suitable governor arrangement is shown in FIG. 1 of U.S. Pat. No. 3,704,963 dated Dec. 5, 1972.

A high pressure pump provided by the rotor 20 is shown as comprising a main pumping chamber 40 formed by a pair of opposed plungers 34 reciprocably mounted in a transverse bore 36 in the rotor.

As will be understood, an annular cam 46 having inwardly projecting cam lobes encircles plungers 34 so that the rotation of the rotor 20 translates the contour of the cam into sequential pumping strokes through the engagement of rollers 44 mounted in shoes 45 with the lobes of cam 46. It will be further understood that metered fuel from metering valve 30 is admitted into pumping chamber 40 through passage 42 to charge the pump rotor 20 and as the rotor 20 continues to rotate, the inward movement of the pump plungers 34 causes the fuel in chamber 40 to be pressurized to a high pressure due to the engagement of rollers 44 with the lobes of the surrounding cam 46 and to be delivered through axial passage 42 for sequential delivery to a plurality of angularly spaced outlet passages surrounding the rotor for delivery to the several cylinders of the engine as the rotor is rotated in a conventional manner such as is more fully disclosed in U.S. Pat. No. 3,771,506, issued Nov. 13, 1973. Maximum outward motion of plungers 34 is limited by the engagement of shoes 45 with the ends of leaf spring 80, the positions of which are adjustable by screw 84 in a manner fully described in U.S. Pat. No. 2,828,697, issued Apr. 1, 1958.

In accordance with one aspect of this invention, means are provided for providing additional fuel for starting the engine. As shown, this means for providing such additional fuel comprises a second or auxiliary high pressure pump having a pumping chamber **40*a*, which is controlled selectively to cooperate and work in unison with the high pressure pump having pumping chamber 40** to deliver high pressure fuel to the engine under staring conditions.

Figure 2:
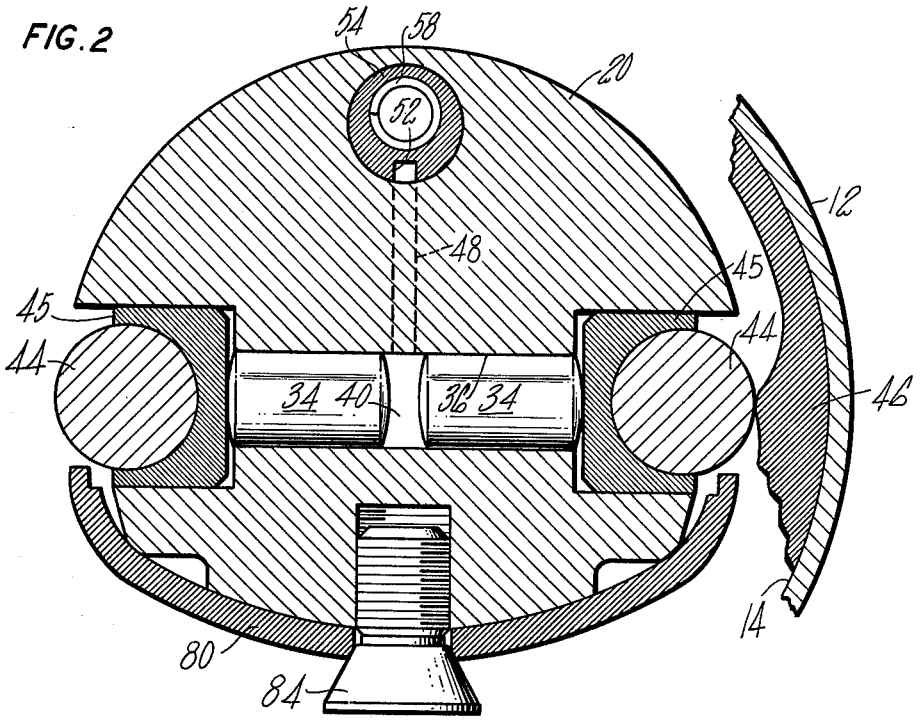
FIG. 2 is a fragmentary cross-sectional view partly broken away, taken generally along the line 2—2 of FIG. 1 showing a rotary distrubutor suited for use in the practice of the invention.
Figure 3:
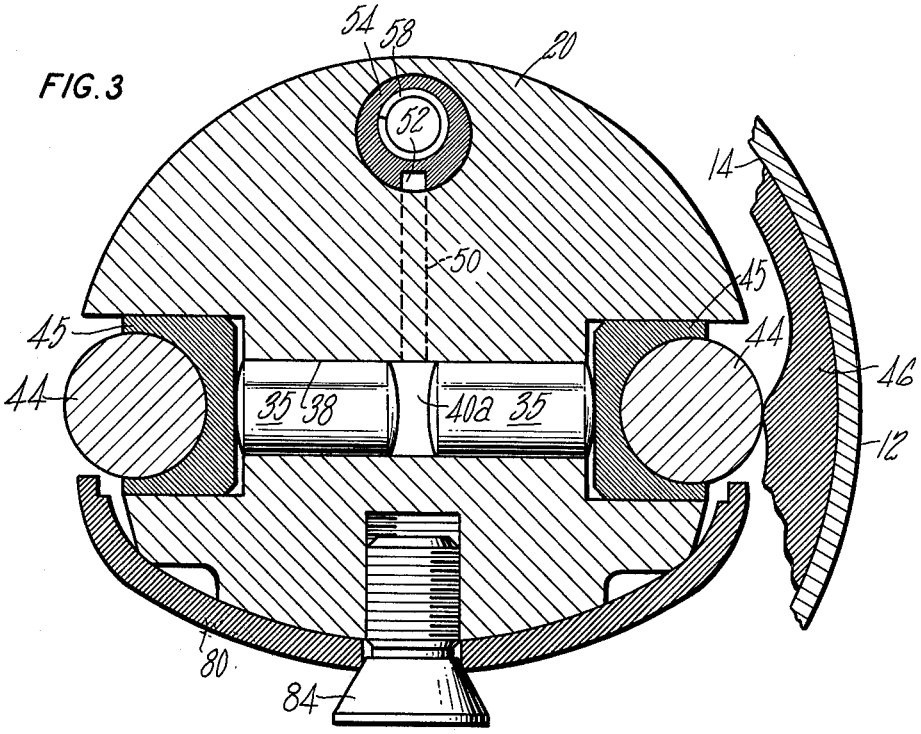
FIG. 3 is a cross-sectional view similar to FIG. 2 taken generally along the line 3—3 of FIG. 1.

The second high pressure pump is shown in FIG. 3 as being identical to the high pressure pump shown in FIG. 2 with the pumping chamber **40*a* between two pumping plungers 35 respectively mounted in a transverse bore parallel to and axially displaced from the bore forming pump chamber 40. The pumping strokes of plungers 35 are shown as being controlled by the same cam 46, rollers 44 and shoes 45 as the pumping strokes of plungers 34. The pumping chamber 40***a* is normally isolated from the pumping chamber 40 but is selectively connected thereto by passage 48, recess 52 of axially slidable piston 54 and passage 50. When piston 54 is positioned to the right as viewed in FIG. 1, communication between chambers 40 and 40*a* is provided by recess 52 and fuel is supplied to the auxiliary pumping chamber 40*a* whenever it is supplied to main pumping chamber 40 and is pressurized therein simultaneously with the charge of fuel in pumping chamber 40 and is delivered through the common outlet rotor passage 42 along with the charge which is pressurized in the pump chamber 40 to increase the amount of fuel delivered per pumping stroke.

Figure 4:
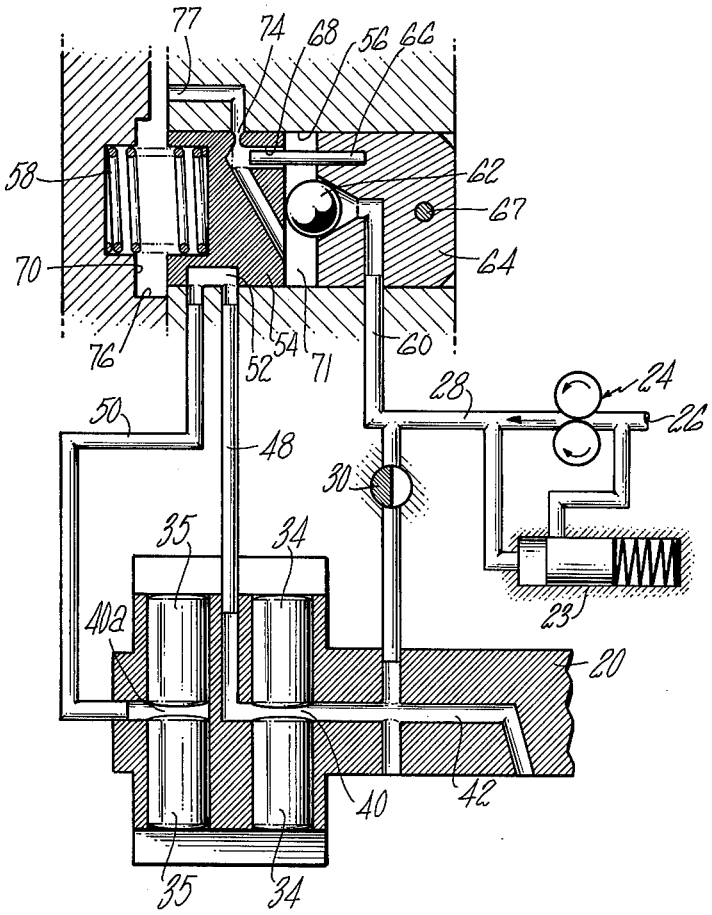
FIG. 4 is a fragmentary schematic view of the invention.

The control of communication between passages 48 and 50 is regulated in accordance with speed. As shown, the piston 54 is mounted for reciprocation in a bore 56 and is biased by a spring 58 to the position illustrated in FIG. 4 at which time recess 52 provides communication between passage 48 and passage 50.

A branch passage 60 is connected to the output of transfer pump 24 to apply fuel pressure continuously against a ball 62 when the engine is operating. When the engine is stopped or is operating at low speeds immediately after cranking, ball 62 is held on its seat 64 by piston 54 under the biasing force of spring 58. Piston 54 is held in fixed angular position by a pin 66 which is fixed in valve seat 64 and is slidably received in an axial hole 68 in piston 54. A pin 67 fixes seat 64 in bore 56.

When the engine is started fuel from transfer pump 24 is supplied through the common inlet and outlet passage 42 to both chambers 40 and 40*a* and is subsequently pressurized and delivered to the engine cylinders. Output pressure from the pump 24 is also applied to the exposed area of the ball 62 in seat 64 through passages 28 and 60. Since output pressure from pump 24 increases with increasing speed, the hydraulic pressure which is exerted on the ball 62 will, at a predetermined speed, say, 1200 rpm, overcome the biasing force of spring 58 and the ball 62 will be lifted from the seat 64 to disable auxiliary chamber 40*a* from the delivery of high pressure fuel to the engine by disconnecting auxiliary chamber 40*a* from the common inlet and outlet passage 42. Transfer pressure will then be applied to the full area of piston 54 which will, due to the sudden increase in the area on which the pressure is applied, snap to a position where it bottoms against the left end 70 of chamber 76 and will be held in that position until transfer pressure has dropped to a very low level such as will occur when the engine is stopped or reaches a very low speed substantially below normal idle speed.

The speed at which the ball 62 is unseated and the speed at which the ball is reseated by the bias of spring 58 acting through piston 54 is determined by the relative seating area of the ball 62, the area of the piston 54, and the spring force of spring 58.

During starting, the leakage of high pressure fuel from the recess 52 of piston 54 to the chamber 71 creates the possibility that the pressure in chamber 71 could increase so that the piston 54 would shift against the bias of spring 58 prematurely to cause the delivery of the increased fuel to the engine to cease prematurely. In order to eliminate this possibility, the chamber 71 is vented to low pressure chamber 76 through an orifice 74 and a passage 77. Loss of fuel from chamber 71 is prevented during normal engine operation after the engine is started, because the orifice 74 does not register with the passage 77 when the piston 54 is moved to its left position for normal engine operation against the bias of the spring 58 as previously described.

When the piston 54 moves to the left, as viewed in FIG. 3, so that it bottoms against the wall 70, the slot 52 no longer registers with passage 48 but serves to provide communication between the passage 50 and chamber 76 to vent the chamber 40*a* to housing pressure. Thus, any residual fuel which may have been in the chamber 40*a* at the instant the piston 54 snapped to its off position can be dumped to avoid any hydraulic lock in the chamber 40*a*.

It will be apparent that this invention provides an arrangement whereby additional fuel is provided at cranking speeds and is automatically continued through the first acceleration to a predetermined speed level at which time such delivery of additional fuel to the engine ceases until the engine is substantially stopped to thereby assure stability of starting. Moreover, it is apparent that this invention provides for increasing both the quantity and rate of fuel delivery to the engine without increasing the duration of the pumping stroke. Since the rate of fuel delivery is increased, the pressure drop across the discharge orifice of the associated injection nozzle is also increased at starting thereby to provide improved atomization of the fuel delivered to the cylinder to improve starting reliability.

Figure 5:
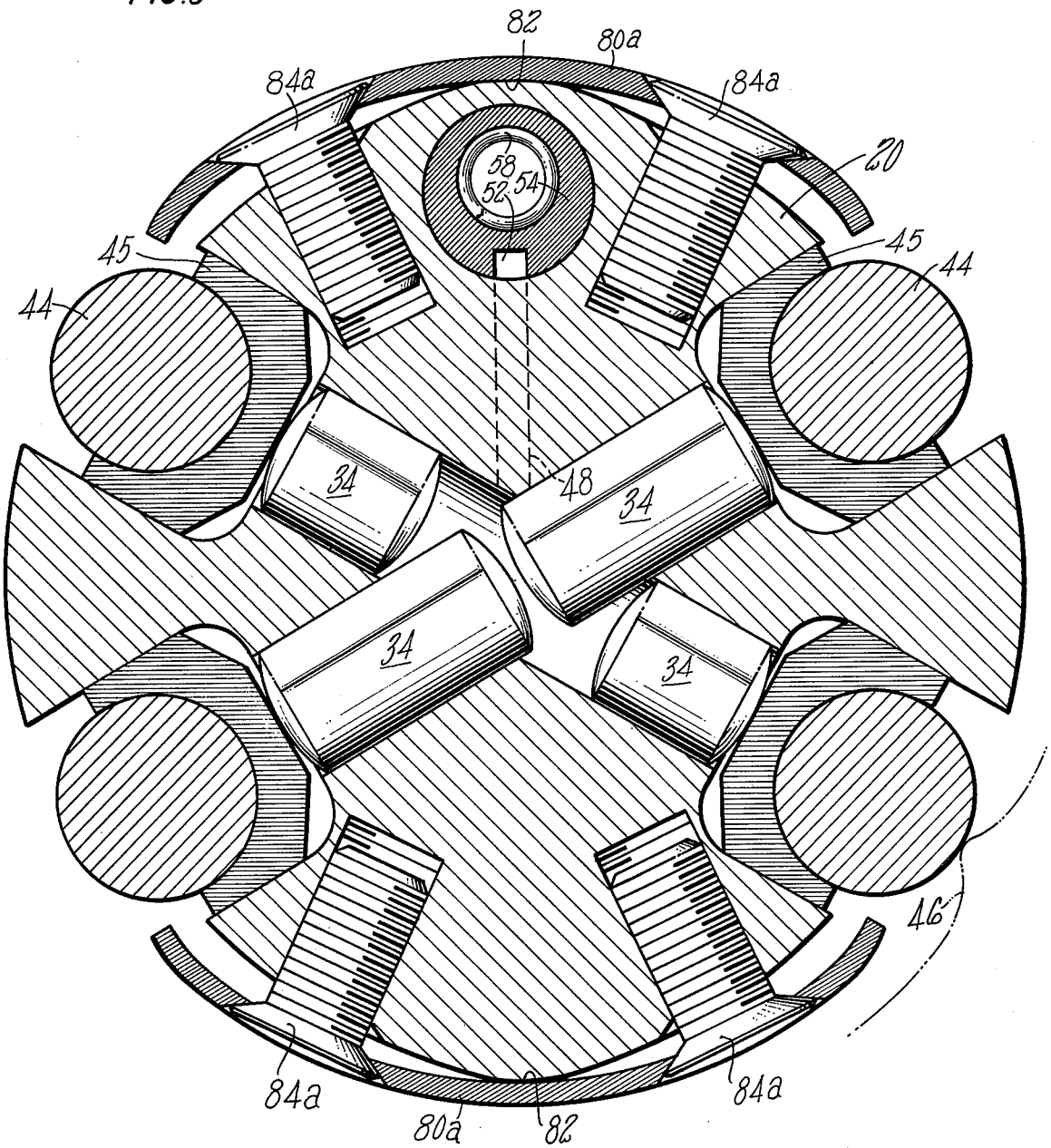
FIG. 5 is a cross-sectional view similar to FIG. 2 showing an alternate arrangement with additional main pumping plungers.

An alternate embodiment of the invention applied to a pump having four main pumping plungers 34 mounted in intersecting transverse bores with the plungers working in unison and arranged for use with a six cylinder engine is shown in FIG. 5. Operation of this embodiment is the same as that of the embodiment of FIGS. 1–4, and the pump can be equipped with an additional pumping chamber having either one or two pairs of fuel plungers. This arrangement uses a different leaf spring adjustment to control the maximum outward stroke of the plungers.

As shown in FIG. 5, leaf springs 80*a* are provided to limit the maximum travel of the shoes 45 and hence the maximum pumping stroke of pistons 34, thereby to limit the maximum charge delivered by the pump. The center of the springs 80*a* are biased against raised periphery abutments 82 of the rotor and a pair of screws 84*a* for each spring are independently adjustable to limit the maximum excursion of the shoes 45. With this arrangement, it will be seen that any of screws 84*a* may be adjusted independently of the others so that the maximum outward travel of all the plungers may be adjusted independently so that the pumping strokes of all the plungers are equal.

As will be apparent to persons skilled in the art, various modifications and adaptations of the foregoing specific disclosure can be made without departing from the teachings of the present invention.

I claim:

1. A rotary distributor fuel injection pump suited for the delivery of pulsed charges of high pressure fuel sequentially to the cylinders of an associated engine comprising a main high pressure pumping chamber and an auxiliary high pressure pumping chamber having a common outlet passage for the delivery of pressurized fuel generated in the pumping chambers to an associated engine, pumping plungers in said pumping chambers having simultaneous pumping strokes for generating high pressure pulsed charges of fuel therein, actuating means for powering said pumping plungers to generate the pulsed charges of fuel in the chambers simultaneously and deliver their combined pulsed output sequentially to each of the cylinders of the engine, and disabling means for rendering said auxiliary pumping chamber inoperative to delivery its output to said common outlet passage without impairing the connection of the main pumping chamber thereto after the enginer speed reaches a predetermined level.

2. The fuel injection pump of claim 1 wherein said disabling means is a valve in a passage connecting said auxiliary chamber to said common outlet passage, said valve being actuated at said predetermined speed to isolate said auxiliary pumping chamber from said outlet passage.

3. The fuel injection pump of claim 2 wherein the inlet passage to said auxiliary pumping chamber and to said main pumping chamber is the same passage as said common outlet passage.

4. The fuel pump of claim 2 including means to generate a hydraulic signal correlated with engine speed, said valve being operated in response to said hydraulic signal.

5. The fuel pump of claim 4 wherein said valve comprises a piston having a recess which selectively provides communication between said pair of pumping chambers, said valves having a chamber at one end thereof providing a port for the delivery of the speed related hydraulic signal thereto, and means associated with said valve for closing said port until a predetermined engine speed is reached.

6. The fuel pump of claim 5 including means for venting the valve chamber before the valve is opened.

7. The fuel pump of of claim 2 including a biasing means for holding said valve in its open position to provide communication between said auxiliary pumping chamber and said common outlet passage, and means responsive to the speed of the engine acting on said valve in opposition to said biasing means to close said valve when the engine reaches a predetermined speed.

8. The fuel injection pump of claim 11 including means for generating a hydraulic pressure correlated with engine speed and wherein said valve is biased toward a first position connecting the auxiliary pumping chamber to the common outlet passage, said valve further being subjected to the force of the speed correlated hydraulic pressure to move the valve to a second position wherein said auxiliary chamber is isolated from said common output passage when said predetermined speed is reached, said hydraulic pressure being first applied to one area to initiate the movement of said valve to its second position at said predetermined speed and then applied to a larger area to maintain said valve in said second position and prevent said valve from returning to said first position until engine speed decreases to a level substantially lower than said predetermined speed.

9. The fuel pump of claim 1 including means for venting said inoperative pumping chamber when the engine speed exceeds said predetermined level.

10. A rotary distributor fuel injection pump as defined in claim 1 including a rotor having radially disposed bores therein forming said pumping chambers, the axis of said pumping chambers being disposed in a common radial plane which passes through the axis of the rotor.

11. A rotary distributor fuel injection pump as defined in claim 10 including a single cam having cam lobes for radially actuating the pumping plungers simultaneously.

12. A rotary distributor fuel injection pump as defined in claim 10 wherein said pumping chambers are axially displaced along the axis of the rotor.

13. A rotary distributor fuel injection pump as defined in claim 12 including a cam means having lobes for actuating the pumping plungers in said pumping chambers inwardly simultaneously to pressurize the charges of fuel therein.

14. The fuel injection pump of claim 2 including a hydraulic chamber, actuating means for said valve disposed in said hydraulic chamber, a source of hydraulic pressure having a level correlated with engine speed connected to said hydraulic chamber, and means for venting said hydraulic chamber before said valve is actuated at said predetermined speed.

15. The fuel injection pump of claim 14 wherein said valve is a restricted orifice.

16. The fuel injection pump of claim 14 wherein said venting means is closed after said valve is actuated to isolate said auxiliary chamber above said predetermined speed.

* * * * *